US005605047A

United States Patent [19]

Park et al.

[11] Patent Number: 5,605,047

[45] Date of Patent: Feb. 25, 1997

[54] ENCLOSURE FOR THERMOELECTRIC REFRIGERATOR AND METHOD

[75] Inventors: Brian V. Park, Austin, Tex.; Ralph D. McGrath, Granville, Ohio

[73] Assignees: Owens-Corning Fiberglas Corp., Granville, Ohio; Oceaneering Space Systems, Houston, Tex.

[21] Appl. No.: 465,731

[22] Filed: Jun. 6, 1995

Related U.S. Application Data

[62] Division of Ser. No. 180,879, Jan. 12, 1994, abandoned.

[51] Int. Cl.[6] ..... F25B 21/02

[52] U.S. Cl. ..... 62/3.6; 62/441

[58] Field of Search ..... 62/3.6, 441

[56] References Cited

U.S. PATENT DOCUMENTS

| | | | |
|---|---|---|---|
| 1,964,795 | 7/1934 | Frary | 428/76 |
| 2,275,365 | 3/1942 | Hintze | 312/406 |
| 2,768,046 | 10/1950 | Evans | 312/406 |
| 2,779,066 | 1/1957 | Gaugler | 428/69 |
| 2,837,899 | 6/1958 | Lindenblad | 62/1 |
| 2,872,788 | 2/1959 | Lindenblad | 62/3 |
| 2,932,953 | 4/1960 | Becket et al. | 62/3 |
| 3,078,682 | 2/1963 | Gould | 62/3 |
| 3,177,670 | 4/1965 | Boehmer et al. | 62/3 |
| 3,177,671 | 4/1965 | Stambaugh | 62/3 |
| 3,240,029 | 3/1966 | Wurtz | 312/401 |
| 3,280,573 | 10/1966 | Brown et al. | 62/3 |
| 3,732,702 | 5/1973 | Desch | 62/3 |
| 3,821,881 | 7/1974 | Harkias | 62/3 |
| 3,823,567 | 7/1974 | Corini | 62/3 |
| 4,007,600 | 2/1977 | Simms | 62/3 |
| 4,043,624 | 8/1977 | Lindenschmidt | 312/406 |
| 4,088,183 | 5/1978 | Anzai et al. | 165/104 |
| 4,146,213 | 3/1979 | Regelin | 266/197 |
| 4,203,487 | 5/1980 | Gartner | 165/50 |

(List continued on next page.)

FOREIGN PATENT DOCUMENTS

| | | | |
|---|---|---|---|
| 0242363 | 12/1962 | Australia | 312/406 |
| 0627705 | 3/1992 | Australia . | |
| 1126180 | 6/1982 | Canada | 192/42 |
| 0342165 | 11/1989 | European Pat. Off. | F25B 21/02 |
| 1125957 | 6/1960 | Germany . | |
| 1198837 | 8/1965 | Germany . | |
| 1401585 | 6/1970 | Germany | 312/406 |
| 2529801 | 2/1976 | Germany | 312/406 |
| 3503281 | 1/1985 | Germany | F25B 21/02 |
| 320580 | 1/1991 | Japan . | |
| 0671283 | 4/1952 | United Kingdom | 312/406 |
| 8101739 | 6/1981 | WIPO | F25B 21/02 |
| 8504948 | 11/1985 | WIPO | F25B 21/02 |
| WO9204301 | 3/1992 | WIPO | C04B 30/02 |

OTHER PUBLICATIONS

"A New Scientific Development in Refrigeration" *Electric & Gas Technology, Inc.*

International Search Report Dated May 31, 1995, PCT/US95/00579.

International Search Report Dated May 19, 1995, PCT/US95/00419.

International Search Report Dated May 24, 1995, PCT/US95/00496.

*Primary Examiner*—William E. Tapolcai

*Attorney, Agent, or Firm*—Baker & Botts, L.L.P.

[57] ABSTRACT

An enclosed structure is provided for use with a refrigerator having a door assembly. The enclosed structure preferably contains superinsulation materials and a plurality of matching drawers. The enclosed structure preferably includes corner joints which minimize thermal energy transfer between adjacent superinsulation panels. The refrigerator may include a cooling system having a thermoelectric device for maintaining the temperature within the refrigerator at selected values. If desired, a fluid cooling system and an active gasket may also be provided between the door assembly and the enclosed structure. The fluid cooling system preferably includes a second thermoelectric device to maintain the temperature of fluid flowing through the active gasket at a selected value. The drawers associated with the refrigerator may be used for gathering, processing, shipping and storing food or other perishable items.

22 Claims, 5 Drawing Sheets

U.S. PATENT DOCUMENTS

| | | | |
|---|---|---|---|
| 4,290,416 | 9/1981 | Maloney | 126/430 |
| 4,317,607 | 3/1982 | Gomolka | 62/441 X |
| 4,326,383 | 4/1982 | Reed et al. | 62/3 |
| 4,328,676 | 5/1982 | Reed | 62/3 |
| 4,346,562 | 8/1982 | Beitner | 62/3 |
| 4,383,414 | 5/1983 | Beitner | 62/3 |
| 4,467,611 | 8/1984 | Nelson et al. | 62/3 |
| 4,570,679 | 2/1986 | Schippl | 138/149 |
| 4,609,036 | 9/1986 | Schrader | 165/10 |
| 4,625,229 | 11/1986 | Maier | 357/81 |
| 4,627,242 | 12/1986 | Beitner | 62/3 |
| 4,637,222 | 1/1987 | Fujiwara | 62/244 |
| 4,644,753 | 2/1987 | Burke | 62/3 |
| 4,662,180 | 5/1987 | Menocal | 62/3 |
| 4,726,193 | 2/1988 | Burke et al. | 62/3 |
| 4,781,329 | 11/1988 | Tenney | 239/305 |
| 4,838,911 | 6/1989 | Robertson et al. | 62/3.3 |
| 4,870,836 | 10/1989 | Pink | 62/441 X |
| 4,878,352 | 11/1989 | Weber et al. | 62/51.1 |
| 4,907,060 | 3/1990 | Nelson et al. | 357/72 |
| 4,922,822 | 5/1990 | Bierschenk et al. | 136/204 |
| 4,984,605 | 1/1991 | Schippl | 138/149 |
| 5,007,226 | 4/1991 | Nelson | 52/809 |
| 5,018,328 | 5/1991 | Cur et al. | 50/406 |
| 5,029,446 | 7/1991 | Suzuki | 62/3.6 |
| 5,064,476 | 11/1991 | Recine, Sr. | 136/201 |
| 5,082,335 | 1/1992 | Cur et al. | 312/401 |
| 5,090,981 | 2/1992 | Rusek, Jr. | 65/4.4 |
| 5,094,899 | 3/1992 | Rusek, Jr. | 428/69 |
| 5,157,893 | 10/1992 | Benson et al. | 52/792 |
| 5,168,339 | 12/1992 | Yokotani et al. | 257/64 |
| 5,171,372 | 12/1992 | Recine, Sr. | 136/203 |
| 5,209,069 | 5/1993 | Newman | 62/3.64 |
| 5,252,408 | 10/1993 | Bridges et al. | 428/621 |
| 5,291,746 | 3/1994 | Abbott | 62/89 |
| 5,301,508 | 4/1994 | Kahl et al. | 62/3.62 |
| 5,315,830 | 5/1994 | Doke et al. | 62/3.2 |
| 5,330,816 | 7/1994 | Rusek, Jr. | 428/69 |
| 5,367,879 | 11/1994 | Doke et al. | 62/3.6 |

FIG. 4
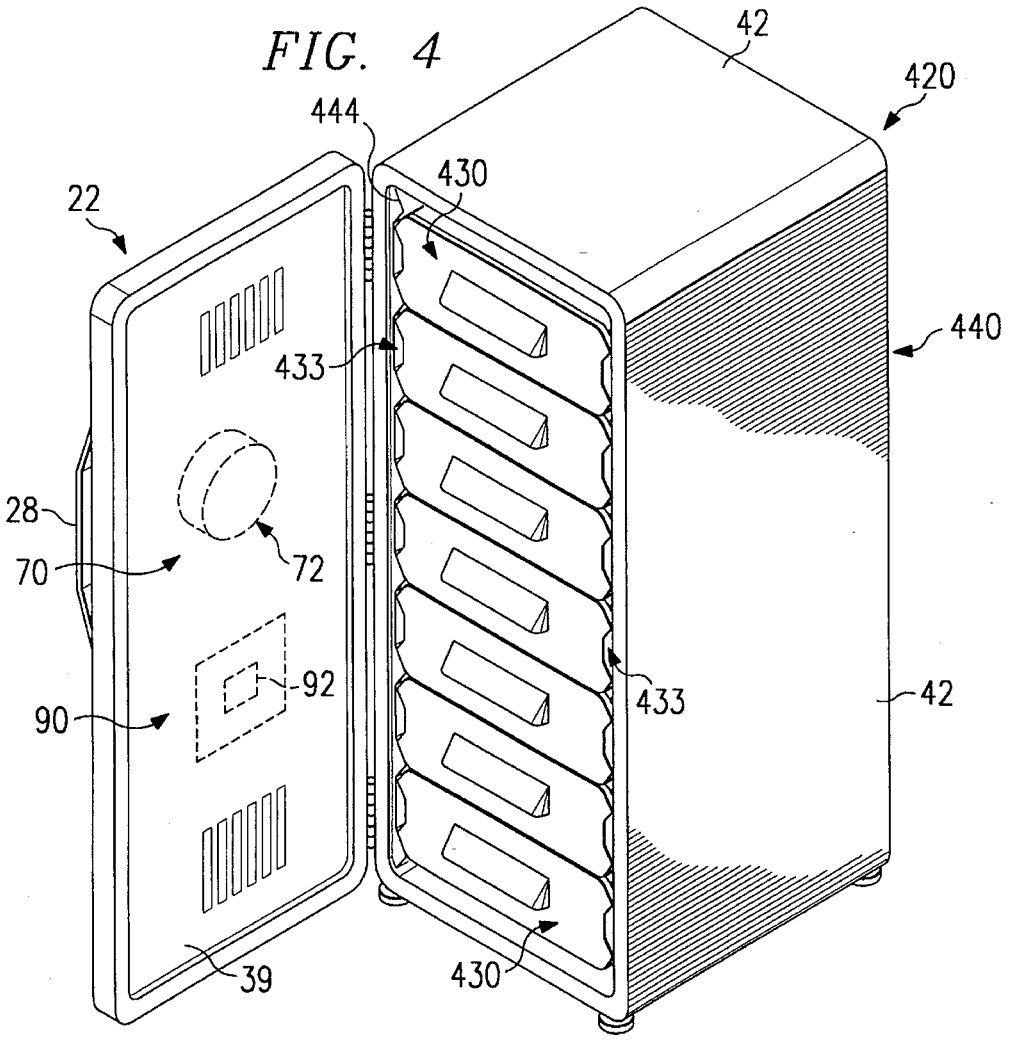
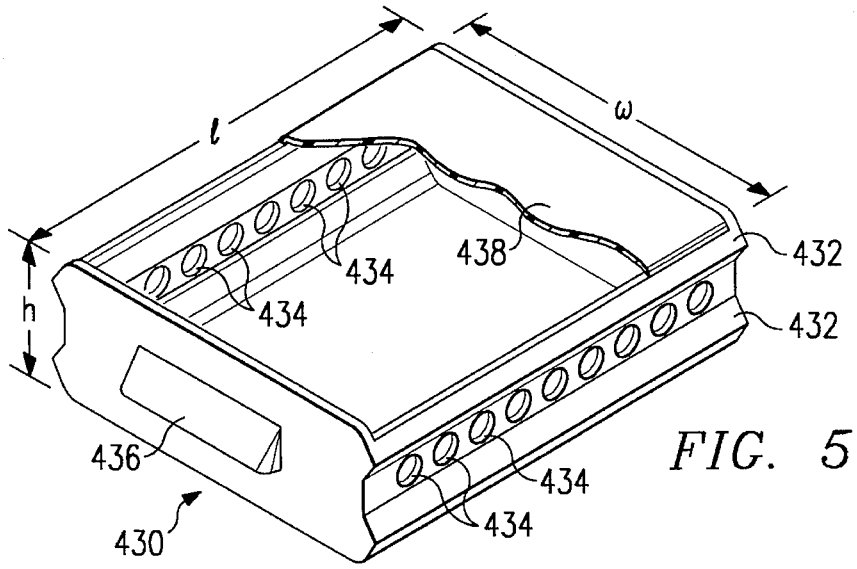
FIG. 5

ENCLOSURE FOR THERMOELECTRIC REFRIGERATOR AND METHOD

NOTICE

Portions of this invention were made with support of the United States Government under contract No. NAS8-5000 awarded by the National Aeronautics and Space Administration (NASA) and subcontract No. GY5509. The Government may have certain rights to the invention under the contract.

This application is a divisional application of U.S. application Ser. No. 08/180,879, filed Jan. 12, 1994, now abandoned in favor of U.S application Ser. No. 08/551/250, filed Oct. 31, 1995. This application is related to U.S. application Ser. No. 08/180,887, filed Jan. 12, 1994; U.S. application Ser. No. 08/180,888, filed Jan. 12, 1994, now U.S. Pat. No. 5,505,046; U.S. application Ser. No. 08/180,456, filed Jan. 12, 1994, now U.S. Pat. No. 5,398,510; and U.S. application Ser. No. 08/409,214, filed Mar. 23, 1994, now abandoned.

BACKGROUND OF THE INVENTION

The basic theory and operation of thermoelectric devices has been developed for many years. Modern thermoelectric devices typically include an array of thermocouples which operate by using the Peltier effect. Thermoelectric devices are essentially small heat pumps which follow the laws of thermodynamics in the same manner as mechanical, heat pumps, refrigerators, or any other apparatus used to transfer heat energy. The principal difference is that thermoelectric devices function with solid state electrical components (thermocouples) as compared to more traditional mechanical/fluid heating and cooling components.

When DC electrical power is applied to a thermoelectric device having an array of thermocouples, heat is absorbed on the cold side of the thermocouples and passes through the thermocouples and is dissipated on the hot side of the thermocouples. A heat sink (sometimes referred to as the "hot sink") is preferably attached to the hot side of the thermoelectric device to aid in dissipating heat from the thermocouples to the adjacent environment. In a similar manner a heat sink (sometimes referred to as a "cold sink") is often attached to the cold side of the thermoelectric device to aid in removing heat from the adjacent environment. Thermoelectric devices are sometimes referred to as thermoelectric coolers. However, since they are a type of heat pump, thermoelectric devices can function as either a cooler or a heater.

There are a wide variety of containers and enclosed structures which are designed to be maintained within a selected temperature range. Examples of such containers and enclosed structures include, but are not limited to, refrigerators, picnic coolers, cabinets containing sensitive electronic equipment, and organ transplant containers. The use of thermoelectric devices which operate on a DC voltage system are well known to maintain desired operating temperatures in refrigerators and portable coolers. An example of a container having a thermoelectric cooler is shown in U.S. Pat. No. 4,726,193 entitled *Temperature Controlled Picnic Box*. Examples of refrigerators which function with a thermoelectric device are shown in U.S. Pat. No. 2,837,899 entitled *Thermoelectric Refrigerator*; U.S. Pat. No. 3,177,670 entitled *Thermoelectric Refrigerator* and U.S. Pat. 3,280,573 entitled *Refrigerator - Package Arrangement*. U.S. Pat. No. 5,168,339, entitled *Thermoelectric Semiconductor Having A Porous Structure Deaerated in a Vacuum and Thermoelectric Panel Using P-Type and N-Type Thermoelectric Semiconductors*, discloses an electronic refrigeration panel.

Conventional refrigerators typically consist of an insulated enclosure with a centralized cooling system based on the vapor compression cycle of fluorinated hydrocarbons (FREON®) or other types of hydrocarbons. The cooling system usually has greater cooling capacity than the actual heat load which results in the cooling system acting intermittently in a binary duty cycle—either on or off. This binary duty cycle results in temperature variations as the refrigerator warms up while the compressor is off and cools down when the compressor is running. Thus the temperature in a typical refrigerator is not steady but cycles between an upper limit and a lower limit. This compressor cycling may reduce the operating efficiency of the associated cooling system.

Presently available cooling systems frequently include an air/evaporator interface which requires a relatively high air flow rate to obtain the best cooling efficiency and to prevent frost or ice from forming on the evaporator. This air flow rate is often in excess of the air velocities required to cool the interior of the refrigerator and results in further system inefficiencies. Finally, vapor compression cooling systems frequently use CFCs (chloro-fluorocarbons) such as FREON® as the working fluid. The negative effects of CFCs on the environment are well known and there exists both national and international regulations to ban the use of such CFCs. Other fluorocarbons such as HCFCs and HFCs have their own limitations and problems for use in refrigeration systems.

SUMMARY OF THE INVENTION

In accordance with the present invention, disadvantages and problems associated with previous thermoelectric refrigerators used to maintain selected temperatures within such refrigerators have been substantially reduced or eliminated. The present invention provides a refrigerator system for terrestrial and microgravity use which combines superinsulation materials with thermoelectric devices to provide an environmentally benign system that is energy efficient and can maintain acceptable temperatures for extended periods of time with little or no power supplied to the refrigerator.

In accordance with one aspect of the present invention, a refrigerator is provided with a thermoelectric assembly, insulating materials having an R-value per inch greater than approximately twenty (R20/inch) and an enclosed structure which provides the required dimensional stability and rigidity for the insulating materials. By using insulating materials having an R-value per inch greater than twenty (R20/inch) (sometimes referred to as "superinsulation materials"), the heat load associated with operating the refrigerator is substantially reduced which makes possible the use of a thermoelectric assembly as part of the cooling system for the refrigerator.

In accordance with another aspect of the present invention, a refrigerator is provided with a cooling system having a the thermoelectric assembly, an enclosed structure formed in part from superinsulation materials, and a plurality of drawers. The drawers may be used during gathering, processing, storage and transportation of food or other perishable items. The drawers include slides and airducts which cooperate to provide a portion of the desired air flow path within the interior of the refrigerator. The same unit can act as a refrigerator or freezer simply by adjusting the set temperature.

Significant technical advantages of the present invention include low power consumption resulting from overall improvements: in the system operating efficiency. The cooling system, superinsulation materials and drawers may be used with various types of containers in addition to refrigerators. By including a plurality of drawers within the refrigerator, heat loss is minimized when the refrigerator door assembly is opened. The drawers are preferably identical to allow integration with the food processing, storage and handling system. Finally, a refrigerator or enclosed structure incorporating the present invention can maintain temperatures for a significant period of time with little or no power supplied to the cooling system.

In accordance with a further aspect of the present invention, a refrigerator is provided with a cooling system having a thermoelectric assembly, an enclosed structure formed in part from superinsulation materials, a door assembly for controlling access to the enclosed structure and an active gasket disposed between the door assembly and the opening to the enclosed structure. A fluid cooling system is also provided to maintain the temperature within the active gasket at desired operating levels.

BRIEF DESCRIPTION OF THE DRAWINGS

For a more complete understanding of the present invention, and the advantages thereof, reference is now made to the following written description taken in conjunction with the accompanying drawings, in which:

FIG. 4 is an isometric drawing of a refrigerator or enclosed structure having a thermoelectric cooling system, superinsulation materials and a plurality of drawers incorporating another embodiment of the present invention;

FIG. 5 is an isometric drawing with portions broken away of a drawer satisfactory for use with the refrigerator of FIG. 4;

DETAILED DESCRIPTION OF THE INVENTION

The preferred embodiments of the present invention and its advantages are best understood by referring to FIGS. 1 through 9 of the drawings, like numerals being used for like and corresponding parts of the various drawings.

Figure 2:
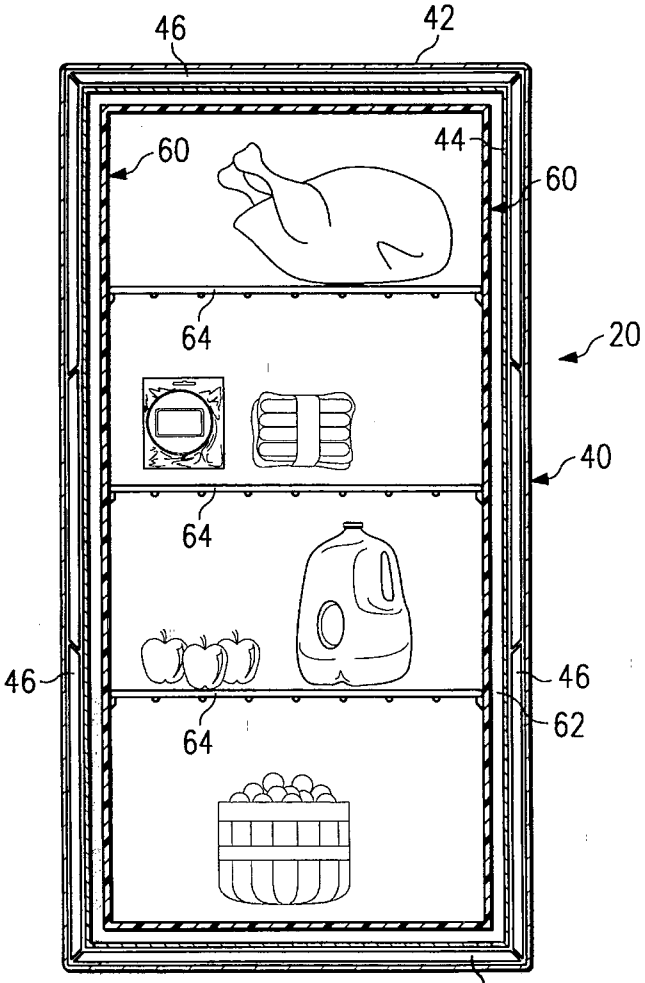
FIG. 2 is a drawing in section with portions broken away taken along lines 2—2 of FIG. 1 showing the use of superinsulation panels, a portion of the internal air flow path, and an internal cabinet associated with the refrigerator of FIG. 1.
Figure 1:
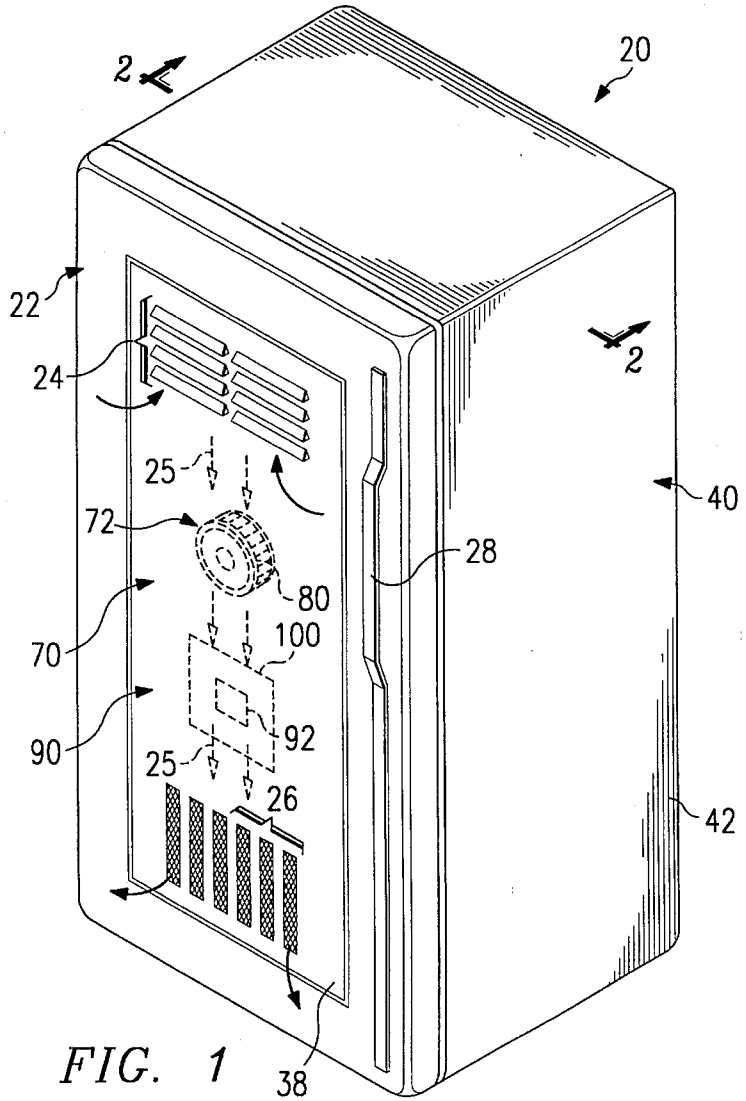
FIG. 1 is an isometric drawing of a refrigerator or enclosed structure having a thermoelectric assembly, superinsulation panels, and an internal air flow path incorporating one embodiment of the present invention.

Refrigerator 20 incorporating one embodiment of the present invention is shown in FIGS. 1 and 2. The principal components of refrigerator 20 include enclosed structure 40 having door assembly 22 with cooling system 70 mounted thereon. Door assembly 22 provides access to the interior of enclosed structure 40. Cooling system 70 mounted on door assembly 22 includes air circulating means 72 and thermoelectric assembly 90. Door assembly 22 preferably includes a plurality of air inlet openings 24 and a plurality of air outlet openings 26. Handle 28 and hinges (not shown) are also provided for use in opening and closing door assembly 22. Refrigerator 20 may function to maintain the temperature in enclosed structure 40 in a selected temperature range, which may be above or below zero degrees Celsius.

As best shown in FIG. 2, enclosed structure 40 preferably includes outer liner 42 and inner liner 44 with a plurality of superinsulation panels 46 disposed therebetween. As will be explained later in more detail, superinsulation panels 46 are preferably included as part of door assembly 22. Also, superinsulation materials other than panels 46 may be satisfactorily used with the present invention. The benefits of the present invention are best achieved by using insulating materials with an R-value per inch greater than approximately twenty (R20/inch). Insulation performance is often measured by use of R-values, where R is a thermal resistivity, and higher R-values indicate better insulating performance. R-value per inch is used to compare the thermal performance of different insulating materials. For example, fiberglass has an R-value per inch of about 3.2 hr-ft$^2$ -F/BTU, while styrene foam has an R-value per inch of about 5 hr-ft$^2$ -F/BTU.

Internal cabinet 60 is preferably disposed within the interior of enclosed structure 40 to partially define air flow path 62 between the exterior of cabinet 60 and interior of inner liner 44. Air flow path 62 may be used to provide a "air curtain" which further enhances the overall performance of cooling system 70 and refrigerator 20. The benefits of providing such an air curtain will be described later in more detail. A plurality of shelves 64 may be provided within internal cabinet 60 for use in storing food or other perishable items within refrigerator 20. The number and location of shelves 64 may be varied depending upon the function and intended uses of refrigerator 20. For some applications, one or more doors (not shown) may be included as part of internal cabinet 60.

For purposes of this patent application, the term "superinsulation panel" is used to refer to insulating material having an R-value per inch (resistance to the transfer of thermal energy) greater than approximately twenty (R20/inch). Various types of superinsulation panels may be satisfactorily used with the present invention. Examples of such superinsulation panels which have a high R-value are shown in U.S. Pat. No. 5,090,981 entitled *Method for*

*Making High R Superinsulation Panel*, and U.S. Pat. No. 5,094,899 entitled *High R Superinsulation Panel*. A preferred superinsulation panel is set forth in pending U.S. patent application Ser. No. 07/993,883, filed Dec. 23, 1992. All of these patents are incorporated by reference for all purposes within this application. Such superinsulation panels are available from Owens-Corning Fiberglas Corporation located in Toledo, Ohio. Owens-Corning uses the trademark "AURA" with respect to such superinsulation panels.

Superinsulation panels 46 shown in FIGS. 2, 3*a*, 3*b* and 6 have a generally rectangular configuration. However, superinsulation panels having square, oval, circular, or any other geometric configuration may be satisfactorily used with the present invention. Superinsulation panels 46 preferably comprise a sealed envelope 48 having a first wall 50 and a second wall 52. Various types of filler material or insulating material 54 and supporting structures 56 may be disposed within envelope 48 between walls 50 and 52. Envelope 48 is preferably formed from gas impervious material and typically sealed around the edges of walls 50 and 52 to maintain the desired vacuum within envelope 48. For some applications, superinsulation panels 46 may be evacuated to a vacuum between $10^{-4}$ Torr ($10^{-4}$ for deep space applications) and 10 Torr.

U.S. Pat. Nos. 5,090,981 and 5,094,899 teach the use of mineral fiber board and particulate matter packed in the interstices of the fiberboard to perform the functions of filler material 54 and supporting structure 56. U.S. Pat. No. 5,157,893 entitled *Compact Vacuum Insulation* teaches the use of spherically shaped glass or ceramic beads which function as filler material 54 and continuous sheets of metal which function as supporting structure 56. U.S. Pat. No. 5,252,408 entitled *Vacuum Insulated Panel and Method of Forming a Vacuum Insulated Panel*, teaches the use of a compressed block of particulate charcoal, activated carbon black, silica gel or other appropriate mixtures to perform the function of filler material 54 and supporting structure 56. U.S. Pat. No. 5,082,335 entitled *Vacuum Insulation System for Insulating Refrigerator Cabinets*, teaches the use of a vacuum insulation panel having multiple sealed compartments containing microporous filler insulation material. Each of the above-referenced patents are incorporated by reference for all purposes within this application.

During the assembly of enclosed structure 40, superinsulation panels 46 are preferably positioned between inner liner 44 and outer liner 42. In a similar manner, during the manufacture of door assembly 22, superinsulation panels 46 are preferably disposed between an inner liner 30 and an outer liner 32. See FIG. 6. As will be described later in more detail, openings 34 and 36 are preferably provided through liners 30 and 32 for use in mounting cooling system 70 with door assembly 22.

As previously noted, the principal components of cooling system 70 include air circulating means 72 and thermoelectric assembly 90. The various components which comprise cooling system 70 are typically mounted on either the exterior portion or the interior portion of door assembly 22 with superinsulation panels 46 disposed therebetween. Cover 38 is preferably placed over the exterior portion of door assembly 22 and cover 39 placed over the interior portion of door assembly 22. Covers 38 and 39 function as part of the air flow management system to establish the desired air flow path within cooling system 70 and refrigerator 20.

Figure 6:
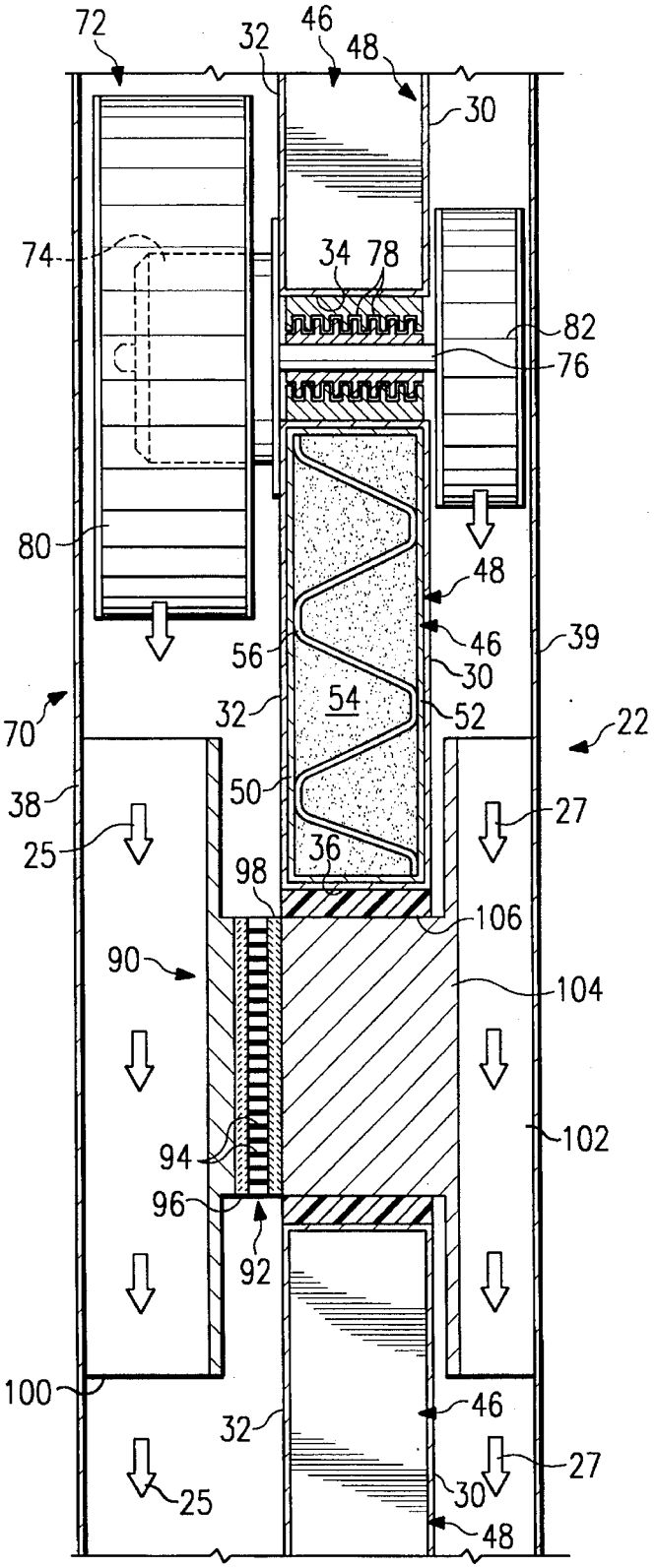
FIG. 6 is a drawing partially in elevation and partially in section with portions broken away showing portions of a door assembly of the refrigerator of FIG. 1 with a cooling system incorporating an aspect of the present invention.

Cooling system 70 shown in FIG. 6 may be satisfactorily used with refrigerator 20, 420 or 720. Air circulating means 72 preferably includes electrical motor 74 mounted on the exterior portion of door assembly 22 adjacent to thermoelectric assembly 90. Rotating shaft 76 preferably extends through electrical motor 74 and opening 34 provided in liners 30 and 32. Sealing means such as a plurality of labyrinth seals 78 are preferably disposed between opening 34 and the adjacent portions of rotating shaft 76 to prevent undesired air flow and resulting thermal energy transfer through opening 34 along rotating shaft 76. Impeller 80 is preferably secured to rotating shaft 76 on the exterior of door assembly 22. Impeller 82 is preferably secured to rotating shaft 76 on the interior portion of door assembly 22. Arrows 25 and 26 show the respective air flow paths from impellers 80 and 82. For some applications, a separate motor (not shown) could be positioned on the interior portion of door assembly 22 for use in rotating impeller 82.

Thermoelectric assembly 90 includes thermoelectric device 92 with first heat sink 100 and second heat sink 102 disposed on opposite sides thereof. Thermoelectric device 92 preferably includes a plurality of thermocouples or thermoelectric elements 94 disposed between thermally conductive plates 96 and 98. For some applications, plates: 96 and 98 may be formed from ceramic and/or composite materials as desired. Thermoelectric elements 94 may be selected from materials such as bismuth telluride to provide an array of P-N junctions with the desired thermoelectric characteristics to allow thermoelectric device 92 to function as a heat pump.

Thermoelectric elements 94 are preferably connected electrically in series and thermally in parallel. An electrical conductor or electrical power cord (not shown) may be provided to supply electrical energy from a twelve (12) volt DC power supply (not shown). The power supply can be a battery, DC power generator, AC/DC converter, or any other appropriate source of DC electrical power. When DC electrical power is supplied to thermoelectric device 92, heat is absorbed on the cold side represented by plate 98 and passes through thermoelectric elements or thermocouples 94 and is dissipated on the hot side at plate 96.

The efficiency of thermoelectric device 92 is substantially improved by attaching first heat sink 100 to hot plate 96 and second heat sink 100 to cold plate 98. Second heat sink 102 preferably includes cold finger 104 which may be positioned within opening 36. Various types of sealing means such as elastomeric material 106 may be disposed between the exterior of cold finger 104 and the interior of opening 36 to prevent air flow and the resulting undesired transfer of thermal energy between the exterior of door assembly 22 to the interior of enclosed structure 40. Cold finger 104 cooperates with opening 36 and seal means 106 to provide a portion of a means for mounting thermoelectric assembly 90 on door assembly 22. Cold finger 104 may be formed as an integral part of second heat sink 102 as shown in FIG. 6. Alternatively, cold finger 104 may be formed as a separate component and bonded with heat sink 102 and conductive plate 98. Various types of bonding techniques and mounting procedures may be used to secure first heat sink 100 and second heat sink 102 with thermoelectric device 92.

When DC electrical power is supplied to thermoelectric device 92, heat energy will flow from the interior of refrigerator 20 through second heat sink 102 and cold finger 104 to conductive plate 98. The heat energy at conductive plate 98 is transferred by thermoelectric elements 94 to conductive plate 96 and dissipated or diffused to the exterior of refrigerator 20 by first heat sink 100. Air circulating means 72 is positioned adjacent to heat sink 100 and/or heat sink 102 to assist with the circulation of air and the transfer of heat energy from the interior of refrigerator 20 to the exterior of refrigerator 20 through thermoelectric assembly 90. U.S. Pat. No. 4,726,193 entitled *Temperature Controlled Picnic Box* shows an example of air circulating means used with a thermoelectric device. U.S. Pat. 4,726,193 is incorporated by reference for all purposes in this application.

Thermoelectric assembly 90 may be mounted on door assembly 22 by using various techniques and procedures. The principal requirement in mounting thermoelectric assembly 90 on door assembly 22 is to ensure that conductive plate 98 of thermoelectric device 92 and cold finger 104 are disposed adjacent to each other. In a similar manner, heat sink 102 and conductive plate 98 are preferably disposed adjacent to each other on the side of thermoelectric device 92 opposite from conductive plate 96 and heat sink 100. Various types of mounting procedures may be satisfactorily used as long as this relationship is maintained between thermoelectric device 92, cold finger 104 and heat sinks 100 and 102.

For many applications of the present invention, cooling system 70 is preferably mounted on door assembly 22. This location minimizes the number of penetrations in enclosed structure 40. By placing cooling system 70 on door assembly 22, it is much easier to maintain and/or repair refrigerator 20. However, an important feature of the present invention is the ability to vary the location of cooling system 70 as required for the specific application in which the resulting refrigerator will be used.

Figure 3A:
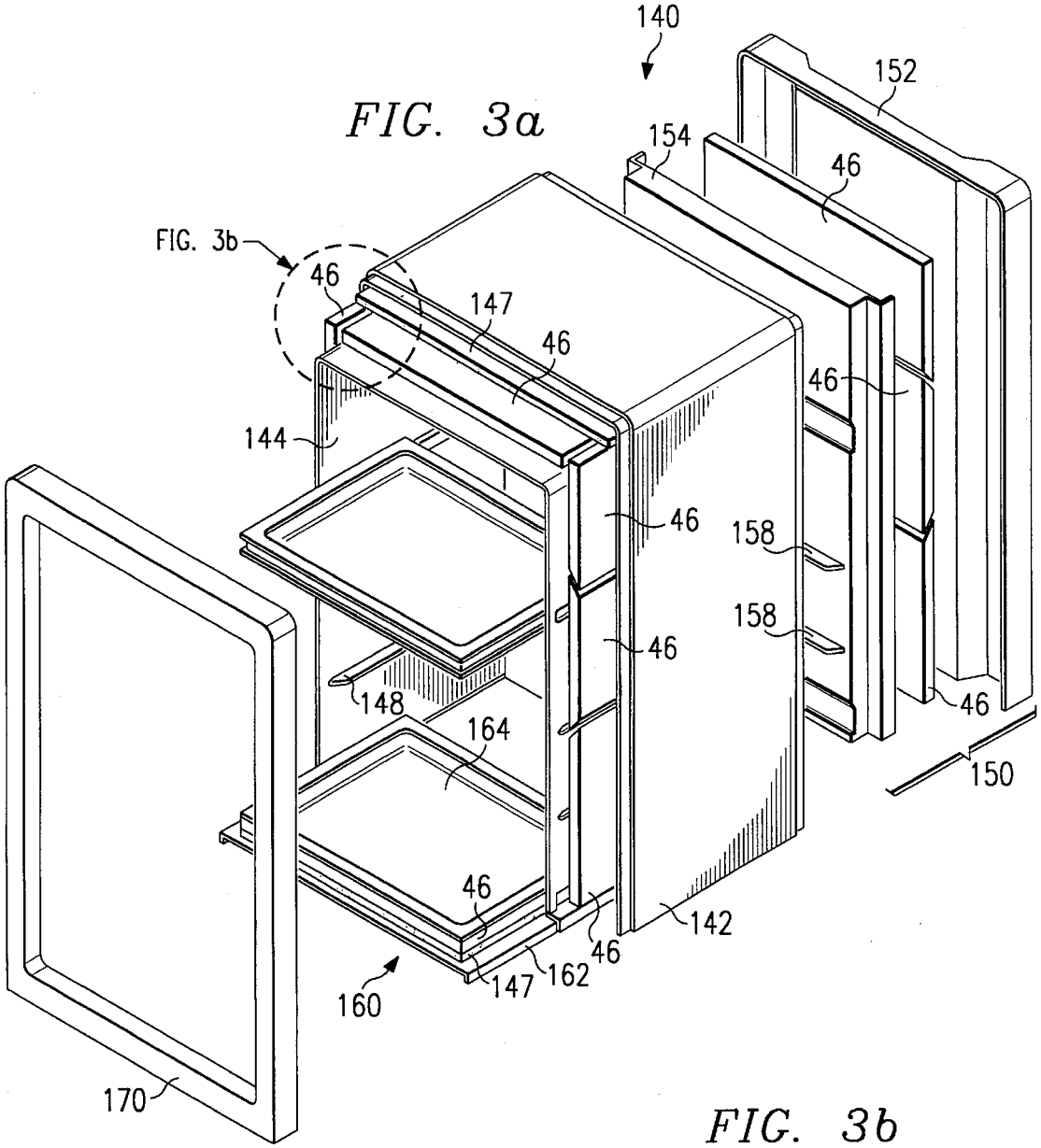
FIG. 3*a* is an exploded isometric drawing with portions broken away showing an enclosed structure and superinsulation panels satisfactory for use in manufacturing a refrigerator in accordance with one embodiment of the present invention.

-Various types of enclosed structures may be satisfactorily used with the present invention. Enclosed structure 140 shown in FIG. 3*a* represents one of these embodiments of the present invention. Enclosed structure 140 preferably includes outer liner 142 and inner liner 144 with a plurality of superinsulation panels 46 disposed therebetween. Outer liner 142 and inner liner 144 preferably have the same general U-shaped configuration with an open back, front and bottom. Inner liner 144 is sized to fit within outer liner 142 with a plurality of superinsulation panels 46 disposed therebetween.

Enclosed structure 140 also includes back wall assembly 150 and floor assembly 160. Back wall assembly 150 preferably includes an outer liner 152 and an inner liner 154 with a plurality of superinsulation panels 46 disposed therebetween. Floor assembly 160 preferably includes outer liner 162 and inner liner 164 with superinsulation panel 46 and insulating foam layer 147 disposed therebetween. Liners 142, 144, 152, 154, 162 and 164 may be formed from fiberglass reinforced plastic or other suitable materials.

Frame 170 is provided on the front portion of enclosed structure 140 to engage the respective inner and outer liners with each other. If desired, one or more rods (not shown) may be disposed between and engaged with frame 170 and back wall assembly 150 to provide additional support for enclosed structure 140. Supports 148 may be provided on the interior surface of inner liner 144 and supports 158 provided on the interior surface of inner liner 154 for use in installing shelves or drawers within enclosed structure 140. Door assembly 22 may be mounted on frame 170 for use in controlling access to the interior of enclosed structure 140. Frame 170 along with liners 142, 144, 152, 154, 162 and 164 cooperate with each other to provide the desired dimensional stability and rigidity required for enclosed structure 140.

Figure 3B:
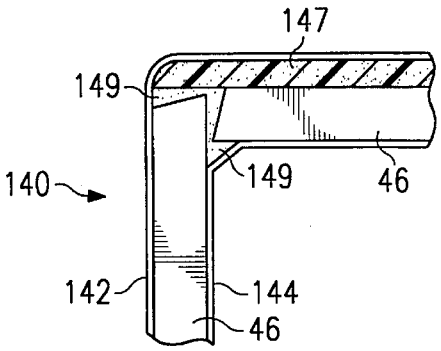
FIG. 3*b* is an enlarged drawing in section with portions broken away showing a corner configuration for superinsulation panels satisfactory for use with the enclosed structure of FIG. 3*a;*

Due to the high R-value associated with superinsulation panels 46 and by placing cooling system 70 on door assembly 22, one of the few locations for "thermal leaks" between the interior and the exterior of an enclosed structure incorporating the present invention occurs at the corners and along the edges of the associated enclosed structure. As best shown in FIG. 3*b* enclosed structure 140 includes a unique configuration of overlapping insulating materials to substantially reduce any heat transfer along the edges of enclosed structure 140.

For example, the top portion of enclosed structure 140 may be formed from multiple layers of material comprising outer liner 142, a layer of foam type insulation material 147, superinsulation panel 46, and inner liner 144. Various types of commercially available insulating materials may be satisfactorily used to provide layer 147 in addition to foam. The dimensions of foam layer 147 are preferably selected to be larger than the adjacent superinsulation panel 46. Thus, foam layer 147 overlaps and extends beyond the perimeter of the associated superinsulation panel 46 as shown in FIG. 3*b*. The resulting corner joint formed between outer liner 142 and inner liner 144 is preferably filled with sealing material of caulking compound 149 which further restricts thermal energy transfer between the overlapping layers of material associated with enclosed structure 140. The overlapping configuration shown in FIG. 3*b* may be used at locations other than the top portion of enclosed structure 140.

If desired, superinsulation materials in a form other than panels 46 may be satisfactorily used with an enclosed structure incorporating the present invention. For example, enclosed structure 140 could be formed by using "a box-in-box technique" to form a generally open rectangular shape box having a configuration which more closely resembles the desired refrigerator as compared to using a plurality of superinsulation panels 46. The use of "a box-in-box technique" to form the superinsulation material would eliminate the need to manufacture a separate floor assembly 160.

Thermoelectric refrigerator 420 is shown in FIG. 4 incorporating another embodiment of the present invention. Some of the principal components of thermoelectric refrigerator 420 preferably include enclosed structure 440 with door assembly 22 mounted thereon, and a plurality of drawers 430 disposed therein. Refrigerator 420 is shown with drawers 430 slidably engaged with inner liner 444. If desired, internal cabinet 60, shown with respect to refrigerator 20, could also be modified to accommodate drawers 430. Enclosed structure 440 is substantially identical with enclosed structure 40 except for drawers 430 which are removably installed in inner liner 444. When door assembly 22 is opened, drawers 430 help to retain cold air within refrigerator 420.

Matching slides 432 are preferably formed on the exterior of each drawer 430 and adjacent portions of inner liner 444 to allow installation and removal of drawers 430 from refrigerator 420. The width (w) of each drawer 430 is slightly less than the width of inner liner 444 which results in forming a gap or airduct 433 defined in part by the associated slides 432 between the exterior of each drawer 430 and the adjacent portion of inner liner 444. A plurality of holes 434 may be formed in the longitudinal sides of each drawer 430 between slides 432 to allow air to circulate within the respective drawer 430. Handles 436 are preferably formed on each end of drawer 430. For some applications, drawers 430 may be installed in enclosed structure 440 using a tongue and groove mechanism (not shown) or other removable, slidable supporting means.

Each drawer 430 preferably has the same height (h) and width (w). However, some drawers 430 may be only one-half the depth or length (l) of enclosed structure 440. Thus, one full size drawer 430 or two half-size drawers may be installed at each location within refrigerator 420. Drawers 430 preferably have identical front and back configurations to allow easy removal and installation within refrigerator 420.

Drawers 430 may be used for multiple purposes including gathering, processing, shipping and storing food or other perishable items within refrigerator 420. If desired, a disposable cover 438 may be provided with each drawer 430. If desired, disposable cover 438 may be removed when drawer 430 is placed within refrigerator 420. Also, elastic straps (not shown) may be provided within each drawer 430 for use in retaining food or other perishable items therein. The use of such straps may be particularly beneficial when refrigerator 420 is mounted on a moving vehicle such as the space shuttle, an aircraft, tank, submarine, etc.

Figure 7:
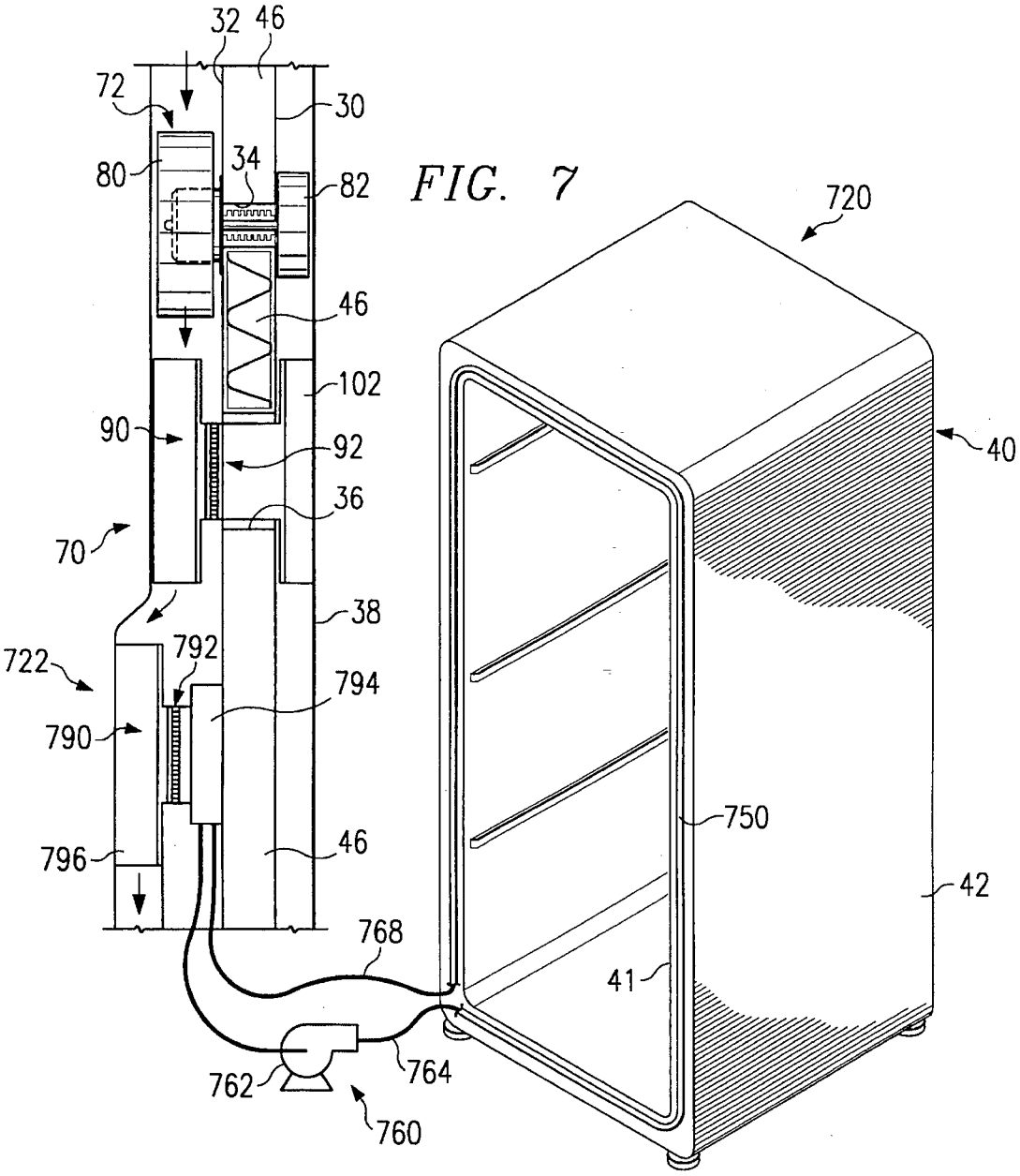
FIG. 7 is a schematic drawing in section and in elevation with portions broken away showing another embodiment of the present invention having a cooling system and an enclosed structure with an active gasket.

For some applications of the present invention, it may be desirable to include one or more gaskets between door assembly 22 and the opening into the associated enclosed structure. It may also be desirable to place an "active gasket" between a door assembly and an enclosed structure incorporating the present invention. Refrigerator 720 is shown in FIG. 7 having active gasket 750 and a fluid cooling system 760 associated therewith. Thermoelectric refrigerator 720 preferably includes door assembly 722 which has been modified to include a second thermoelectric cooling assembly 790 as part of the fluid cooling system 760. Various types of gases or liquids may be used as the fluid for system 760.

Active gasket 750 is preferably a flexible hollow conduit disposed of the perimeter or face opening 41 to enclosed structure 40. Active gasket 750 may be formed from various polymeric and/or elastomeric materials. Fluid cooling system 760 includes pump 762 to direct fluid from heat exchanger 794 through active gasket 750 and back to heat exchanger 794. Thermoelectric assembly 790 is used to remove heat from fluid flowing through cooling system 760 in the same manner as previously described for thermoelectric assembly 90. Fluid supply line 764 and fluid return line 768 are included as part of cooling system 760. For some applications, it may be appropriate to have a plurality of gaskets between door assembly 722 and enclosed structure 40.

Figure 8:
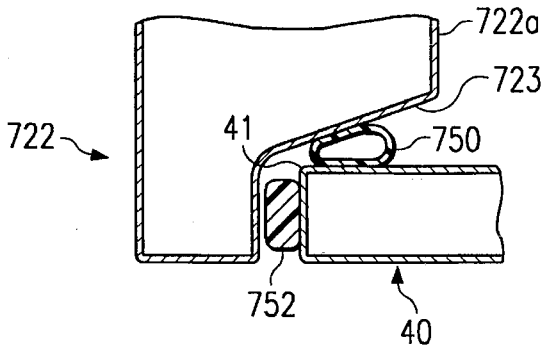
FIG. 8 is an enlarged schematic drawing in section with portions broken away showing a passive gasket and an active gasket as part of another embodiment of the present invention.

For other applications, it may be preferable to place active gasket 750 on the interior of opening 41 to enclosed structure 40 as compared to placing active gasket 750 on the face of opening 41 as shown in FIG. 7. FIG. 8 is a schematic representation showing the use of passive gasket 752 along with active gasket 750. Also, door assembly 722 associated with such an enclosed structure includes an extended portion 722*a* which is designed to fit within opening 41. If desired, door assembly 722 may include tapered surface 723 which better allows door assembly 722 to fit within opening 41 and to contact active gasket 750. Cooling fluid may be supplied to active gasket 750 in the same manner as previously described. Also, when cooling fluid is supplied to active gasket 750, gasket 750 will have a tendency to expand which further enhances the thermal barrier formed between the interior of enclosed structure 40 and the associated door assembly 722.

Figure 9:
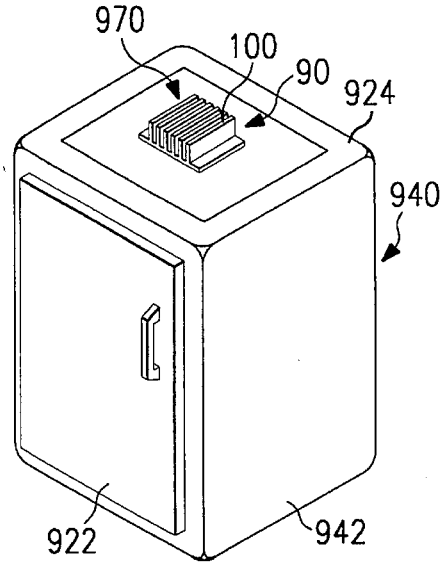
FIG. 9 is an isometric drawing of a refrigerator or enclosed structure incorporating a further embodiment of the present invention.

FIG. 9 depicts an additional embodiment of the present invention. Refrigerator 920 and enclosed structure 940 are preferably fabricated with superinsulation materials as previously described for refrigerators 20, 420 and 720. Also, refrigerator 920 may include a plurality of drawers as previously described for refrigerator 420. One of the principal differences between refrigerator 920 and previously described refrigerators 20, 420 and 720 is represented by locating cooling system 970 on the top 924 of refrigerator 920. Cooling system 970 preferably includes thermoelectric assembly 90 having heat sink 100, thermoelectric device 92 (not shown) and heat sink 102 (not shown). Air circulating means 72 has not been included as part of cooling system 970. Also door assembly 922 has been substantially modified by moving cooling system 970 to the top portion 924 of refrigerator 920.

The present invention may be used with various types of enclosed structures such as a cabinet for electronic equipment, pharmaceutical storage, organ transplant containers, etc. Cooling system 70, superinsulation panels 46 and drawers 430 incorporating the present invention are not limited to use with refrigerators.

Although the present invention and its advantages have been described in detail, it should be understood that various changes, substitutions and alterations can be made without departing from the spirit and scope of the invention as defined by the following claims.

What is claimed is:

1. A thermoelectric refrigerator comprising:

an enclosure having five walls and an opening to the interior of the enclosure;

a door assembly mounted on the opening for selectively controlling access to the interior of the enclosure;

a thermoelectric assembly for maintaining the temperature in the interior of the enclosure within a selected range;

the walls formed from superinsulation materials having an overall R-value per inch of greater than approximately twenty (R20/inch); and a plurality of drawers slidably disposed within the enclosure.

2. The thermoelectric refrigerator of claim 1 wherein the superinsulation materials further comprise a plurality of vacuum panels.

3. The thermoelectric refrigerator of claim 1 further comprising each drawer having an identical height and width with a handle on each end of the respective drawer.

4. The thermoelectric refrigerator of claim 1 wherein the thermoelectric assembly further comprises a thermoelectric device with a first heat sink disposed on the exterior of the refrigerator and a second heat sink disposed on the interior of the refrigerator.

5. The thermoelectric refrigerator of claim 1 further comprising:

the thermoelectric device mounted on the door assembly with the first heat sink disposed on the exterior portion of the door assembly and the second heat sink disposed on the interior portion of the door assembly; and the door assembly comprising a plurality of vacuum panels having an R-value per inch greater than approximately twenty (R20/inch).

6. A thermoelectric refrigerator comprising:

an enclosure having five walls and an opening to the interior of the enclosure;

a door assembly mounted on the opening for selectively controlling access to the interior of the enclosure;

a thermoelectric assembly for maintaining the temperature in the interior of the enclosure within a selected range;

the walls formed from superinsulation materials having an overall R-value per inch of greater than approximately twenty (R20/inch);

a plurality of drawers slidably disposed within the enclosure;

a plurality of matching slides formed on the interior of the enclosure and each drawer;

an air flow passage formed between the sides of each drawer and the adjacent interior portion of the enclosure;

a plurality of openings in the side of each drawer; and the air flow passage and the openings cooperating with each other to allow air circulation within the enclosure and through the respective drawers.

7. A thermoelectric refrigerator with an enclosed structure having an interior comprising:

a thermoelectric cooling system mounted on the enclosed structure for controlling the temperature within the interior of the enclosed structure;

the thermoelectric cooling system having a thermoelectric device with a first heat sink disposed on one side of the thermoelectric device and a second heat sink disposed on the other side of the thermoelectric device;

a first impeller for providing a first air flow and the first impeller mounted on the exterior of the enclosed structure;

a second impeller for providing a second air flow disposed on the interior of the enclosed structure;

the first impeller located adjacent to the first heat sink and the second impeller located adjacent to the second heat sink;

the first heat sink disposed within the first air flow from the first impeller; the second heat sink disposed within the second air flow from the second impeller;

the enclosed structure having an outer liner and an inner liner with a plurality of vacuum panels containing superinsulation materials disposed therebetween;

the superinsulation materials having an overall R-value per inch of greater than twenty (R20/inch);

the superinsulation materials in cooperation with the second air flow path substantially reducing the electrical power requirements of the thermoelectric cooling system; and a plurality of drawers slidably disposed within the inner liner.

8. The thermoelectric refrigerator of claim 7 further comprising the drawers having an identical height and an identical width.

9. The thermoelectric refrigerator of claim 7 further comprising:

the inner liner having a first width and each drawer having a second width which is less than the first width of the inner liner; and an air gap formed by the difference between the second width of the drawers and adjacent first width of the inner liner to accommodate a portion of the second air flow within the enclosed structure.

10. The thermoelectric refrigerator of claim 7 further comprising:

the inner liner having a first width and a first depth;

each drawer having a second width which is slightly less than the first width of the inner liner; and at least two of the drawers having a depth equal to one half of the depth of the inner liner whereby two drawers may be installed at the same location within the inner liner.

11. A thermoelectric refrigerator with an enclosed structure having an interior comprising:

a thermoelectric cooling system mounted on the enclosed structure for controlling the temperature within the interior of the enclosed structure;

the thermoelectric cooling system having a thermoelectric device with a first heat sink disposed on one side of the thermoelectric device and a second heat sink disposed on the other side of the thermoelectric device;

a first impeller for providing a first air flow and the first impeller mounted on the exterior of the enclosed structure;

a second impeller for providing a second air flow disposed on the interior of the enclosed structure;

the first impeller located adjacent to the first heat sink and the second impeller located adjacent to the second heat sink;

the first heat sink disposed within the first air flow from the first impeller;

the second heat sink disposed within the second air flow from the second impeller;

the enclosed structure having an outer liner and an inner liner with a plurality of superinsulation materials disposed therebetween;

the superinsulation materials having an overall R-value per inch of greater than twenty (R20/inch);

the superinsulation materials in cooperation with the second air flow path substantially reducing the electrical power requirements of the thermoelectric cooling system;

a plurality of drawers slidably disposed within the inner liner;

a plurality of matching slides formed on the inner liner and along each side of each drawer;

an air flow passage formed between the sides of each drawer and the adjacent inner liner;

a plurality of openings in the side of each drawer; and the air flow passage and the openings cooperating with each other to allow air circulation through the drawers.

12. A thermoelectric refrigerator having an enclosed structure with an interior and a door mounted on the enclosed structure for providing access to the interior of the enclosed structure, comprising:

a plurality of superinsulated walls forming the enclosed structure;

each superinsulated wall having a plurality of vacuum panels;

a thermoelectric device mounted on the enclosed structure with the thermoelectric device having a hot side and a cold side with a first heat sink coupled to the hot side and a second heat sink coupled to the cold side;

the first heat sink disposed on the exterior of the enclosed structure and the second heat sink disposed on the interior of the enclosed structure;

an air flow management system having means for circulating air with respect to the first heat sink and means for circulating air with respect to the interior of the enclosed structure and the second heat sink;

the superinsulated walls in cooperation with the air flow management system substantially reducing the electrical requirements of the thermoelectric device; and a plurality of drawers slidably disposed within the enclosed structure.

13. The thermoelectric refrigerator of claim 12 wherein the superinsulated walls comprise a gas impervious material and have an R-value per inch greater than twenty (R20/inch).

14. The thermoelectric refrigerator of claim 12 wherein superinsulated walls comprise vacuum panels selected from the group consisting of vacuum panels filled with mineral fiberboard, vacuum panels filled with glass beads, and vacuum panels filled with microporous filler material.

15. The thermoelectric refrigerator of claim 12 further comprising:

each drawer having an identical height;

each drawer having an identical width; and a handle on each end of each drawer.

16. The thermoelectric refrigerator of claim 12 wherein the enclosed structure further comprises:

an outer liner and an inner liner having a generally U-shaped configuration with an open back, front and bottom; and the inner liner sized to fit within the outer liner with the plurality of vacuum panels disposed therebetween.

17. The thermoelectric refrigerator of claim 12 wherein the enclosed structure further comprises:

a back wall assembly with an outer liner and an inner liner with a plurality of vacuum panels disposed therebetween; and the floor assembly having an outer liner and an inner liner with a plurality of superinsulation panels disposed therebetween.

18. The thermoelectric refrigerator of claim 16 wherein the enclosed structure further comprises:

a frame mounted on the front of the generally U-shaped outer liner and inner liner; and the door assembly mounted on the frame.

19. The thermoelectric refrigerator of claim 12 further comprising at least one of the drawers used to process, ship, and store food.

20. The thermoelectric refrigerator of claim 12 further comprising:

each drawer having a front and a back with a pair of longitudinal sides disposed therebetween; and the front and the back of each drawer having an identical configuration to allow easy removal from and installation within the thermoelectric refrigerator.

21. A thermoelectric refrigerator having an enclosed structure with an interior and a door mounted on the enclosed structure for providing access to the interior of the enclosed structure, comprising:

a plurality of superinsulated walls forming the enclosed structure;

each superinsulated wall having a plurality of vacuum panels;

a thermoelectric device mounted on the enclosed structure with the thermoelectric device having a hot side and a cold side with a first heat sink coupled to the hot side and a second heat sink coupled to the cold side;

the first heat sink disposed on the exterior of the enclosed structure and the second heat sink disposed on the interior of the enclosed structure;

an air flow management system having means for circulating air with respect to the first heat sink and means for circulating air with respect to the interior of the enclosed structure and the second heat sink;

the superinsulated walls in cooperation with the air flow management system substantially reducing the electrical requirements of the thermoelectric device;

a plurality, of drawers slidably disposed within the enclosed structure; and at least one drawer has a disposable cover.

22. A thermoelectric refrigerator having an enclosed structure with an interior and a door mounted on the enclosed structure for providing access to the interior of the enclosed structure, comprising:

a plurality of superinsulated walls forming the enclosed structure;

each superinsulated wall having a plurality of vacuum panels;

a thermoelectric device mounted on the enclosed structure with the thermoelectric device having a hot side and a cold side with a first heat sink coupled to the hot side and a second heat sink coupled to the cold side;

the first heat sink disposed on the exterior of the enclosed structure and the second heat sink disposed on the interior of the enclosed structure;

an air flow management system having means for circulating air with respect to the first heat sink and means for circulating air with respect to the interior of the enclosed structure and the second heat sink;

the superinsulated ,Nails in cooperation with the air flow management system substantially reducing the electrical requirements of the thermoelectric device;

a plurality of drawers slidably disposed within the enclosed structure;

a plurality of matching slides formed on the interior of the enclosed structure and along each side of each drawer;

an air flow passage formed between the sides of each drawer and the adjacent interior portion of the enclosed structure;

a plurality of openings in the side of each drawer; and the air flow passage and the openings cooperating with each other to allow air circulation within the enclosed structure and through the respective drawers.

* * * * *

UNITED STATES PATENT AND TRADEMARK OFFICE

CERTIFICATE OF CORRECTION

PATENT NO. : 5,605,047
DATED : February 25, 1997
INVENTOR(S) : Park et al.

It is certified that error appears in the above-identified patent and that said Letters Patent is hereby corrected as shown below:

Column 1, lines 4-11 delete

"NOTICE

Portions of this invention were made with support of the United States Government under contract No. NAS8-5000 awarded by the National Aeronautics and Space Administration (NASA) and subcontract No. GY5509. The Government may have certain rights to the invention under the contract."

and insert

UNITED STATES PATENT AND TRADEMARK OFFICE

CERTIFICATE OF CORRECTION

PATENT NO. : 5,605,047

DATED : February 25, 1997

INVENTOR(S) : Park et al.

It is certified that error appears in the above-identified patent and that said Letters Patent is hereby corrected as shown below:

-- NOTICE

Portions of the invention described herein were made in the performance of work under National Aeronautics and Space Administration (NASA) Contract No. NASA-50000, subcontract No. GY5509 and are subject to the provisions of Section 3.05 of the National Aeronautics and Space Act of 1958 (42 U.S.C. 2457). --.

Signed and Sealed this

Twenty-second Day of December, 1998

*Attest:*

Bruce Lehman

BRUCE LEHMAN

*Attesting Officer*

*Commissioner of Patents and Trademarks*